United States Patent [19]

Freiborg

[11] Patent Number: 4,672,790

[45] Date of Patent: Jun. 16, 1987

[54] MULTI-PIECE ASPHALT COMPOSITION ROOFING SYSTEM

[76] Inventor: Bennie Freiborg, 4536 Indiana Ave., La Canada, Calif. 91011

[21] Appl. No.: 786,732

[22] Filed: Oct. 11, 1985

Related U.S. Application Data

[63] Continuation of Ser. No. 356,937, Mar. 10, 1982, abandoned.

[51] Int. Cl.[4] ..... E04D 1/00

[52] U.S. Cl. ..... 52/521; 52/540; 52/545; 52/554

[58] Field of Search ..... 52/459, 462, 518–521, 52/528, 529, 540, 544, 545, 554, 555; D25/80

[56] References Cited

U.S. PATENT DOCUMENTS

| | | | |
|---|---|---|---|
| 358,888 | 3/1887 | Sagendorph | 52/529 |
| 884,285 | 4/1908 | Moomaw | 52/529 |
| 1,410,299 | 3/1922 | Harshberger | 52/545 |
| 1,435,623 | 11/1922 | Saxe | 52/278 |
| 1,547,498 | 7/1925 | Jordon | 52/545 |
| 1,596,272 | 8/1926 | Jordon | 52/521 |
| 1,619,600 | 3/1927 | Cumfer | 52/529 |
| 1,795,913 | 3/1931 | Weaver | 52/518 |
| 1,848,965 | 3/1932 | Miller | 52/540 |
| 1,975,986 | 10/1934 | Straus | 52/545 |
| 2,005,219 | 6/1935 | Burgiss | 52/519 |
| 2,042,890 | 6/1936 | Fulenwinder et al. | 52/529 |
| 2,059,233 | 11/1936 | Harshberger | 52/529 |
| 2,089,490 | 8/1937 | Kuhn | 52/529 |
| 2,189,159 | 2/1940 | Anschicks | 52/470 |
| 2,253,753 | 8/1941 | Black | 52/545 |
| 3,520,099 | 7/1970 | Mattes | 52/521 |
| 3,875,718 | 4/1975 | Boyd | 52/545 |
| 3,903,340 | 9/1975 | Sheperd | 52/518 |
| 3,913,294 | 10/1975 | Freiborg | 52/518 |
| 3,999,348 | 12/1976 | Hicks | 52/544 |
| 4,226,069 | 10/1980 | Hinds | 52/521 |
| 4,288,958 | 9/1981 | Chalmers et al. | 52/478 |
| 4,320,613 | 3/1982 | Kaufman | 52/521 |
| 4,322,928 | 4/1982 | Freiborg | 52/521 |
| 4,404,783 | 9/1983 | Freiborg | 52/528 |

FOREIGN PATENT DOCUMENTS

| | | | |
|---|---|---|---|
| 506333 | 8/1920 | France | 52/520 |
| 744271 | 2/1956 | United Kingdom | 52/529 |

*Primary Examiner*—John E. Murtagh
*Assistant Examiner*—Andrew Joseph Rudy
*Attorney, Agent, or Firm*—Blakely, Sokoloff, Taylor & Zafman

[57] ABSTRACT

An asphalt composition roof covering system for roofing and reroofing is comprised of a base and a plurality of tabs cut from standard rolls of asphalt composition material. The base has first, second and third regions separated by a first and second fold so as to provide a "Z" shape. The plurality of folded tabs are inserted into the third region of the base to give a three-dimensional appearance. In addition, when the system is used for reroofing over existing shake roofs, a spacer is provided along the inclined plane of a shingle to raise the base.

29 Claims, 12 Drawing Figures

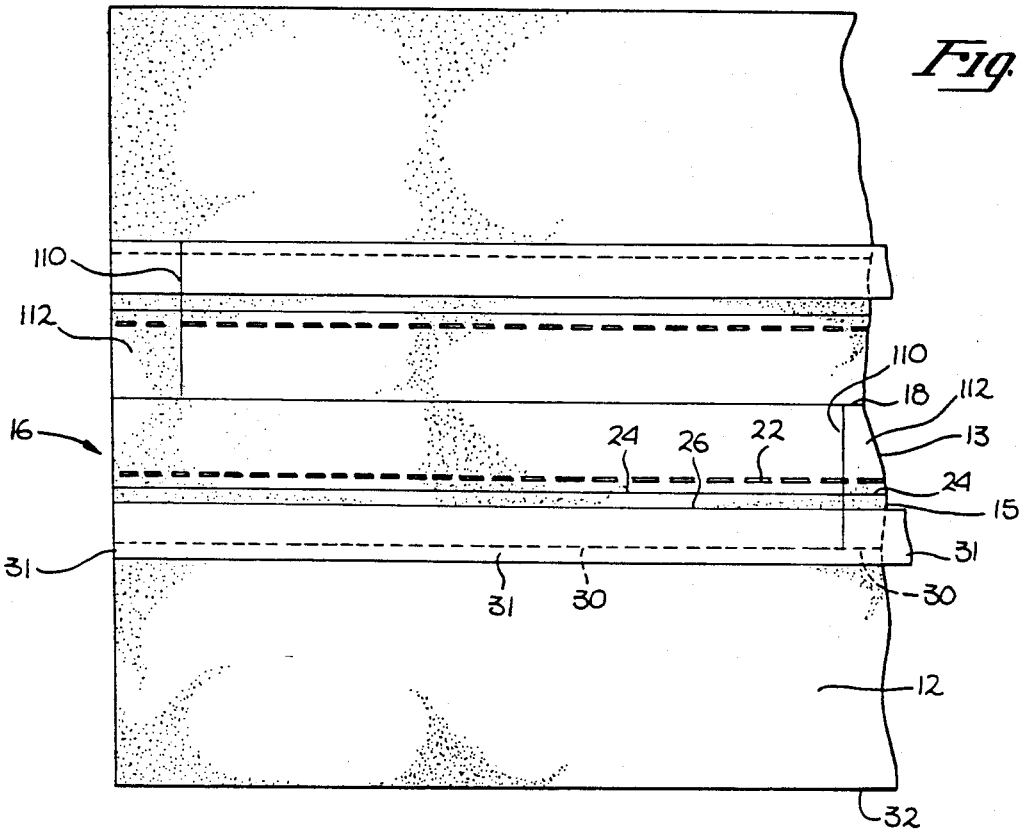
Fig. 1
Fig. 2
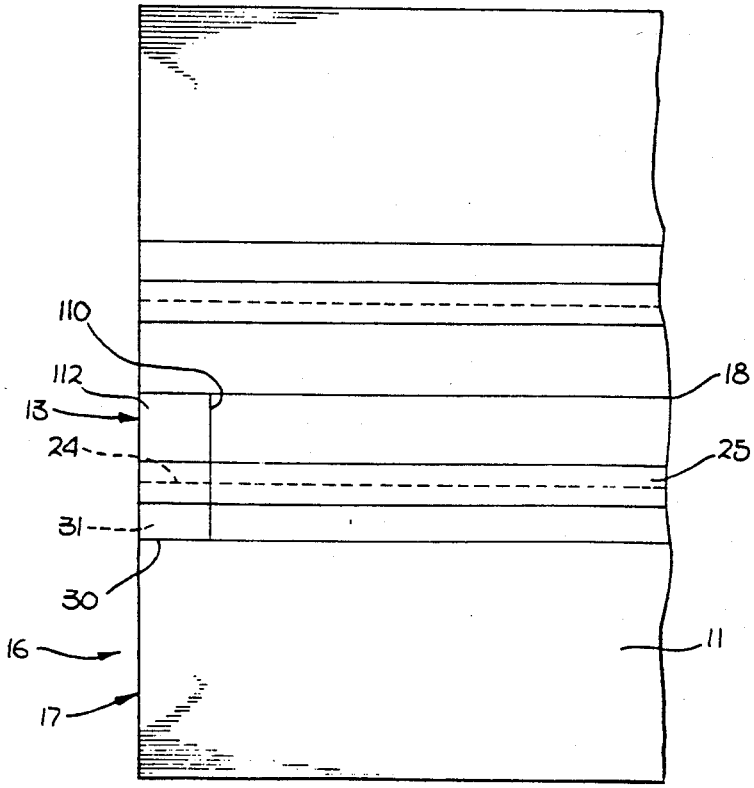

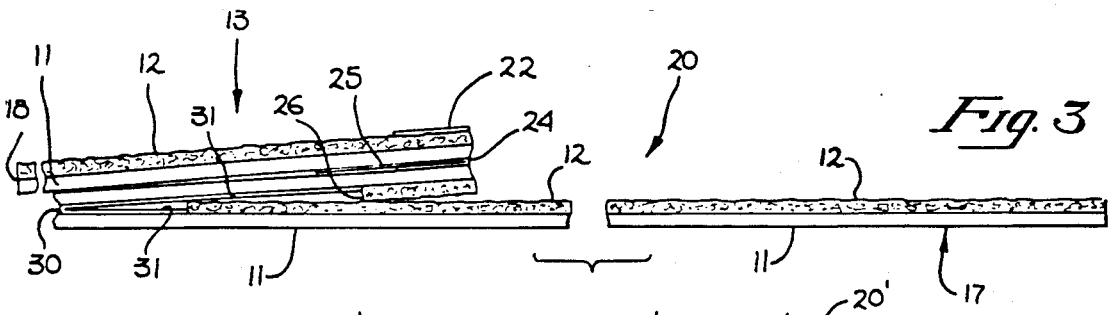
Fig. 3
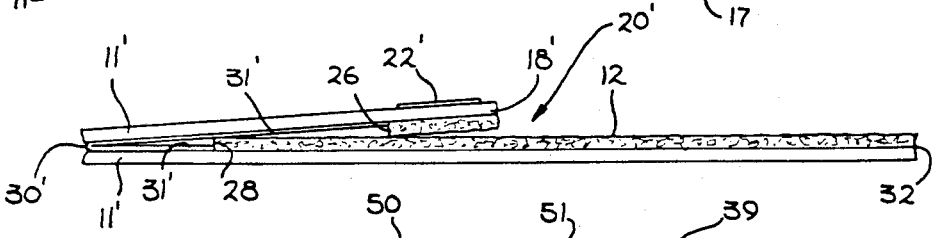
Fig. 4
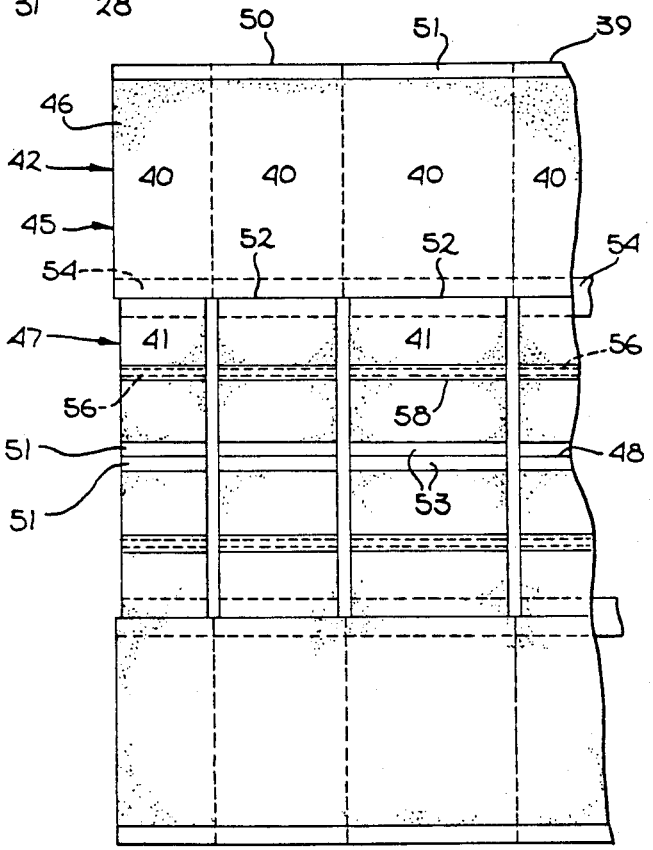
Fig. 5
Fig. 6
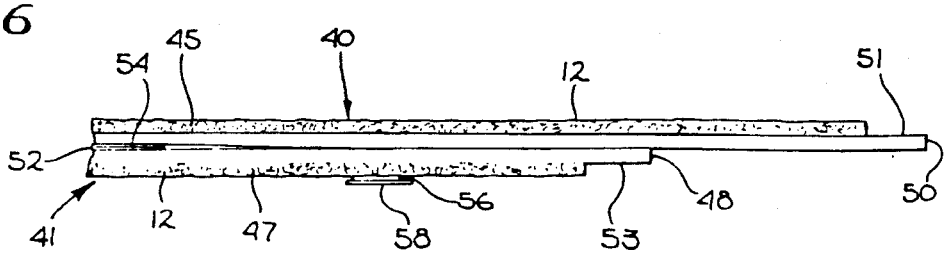

Fig. 9
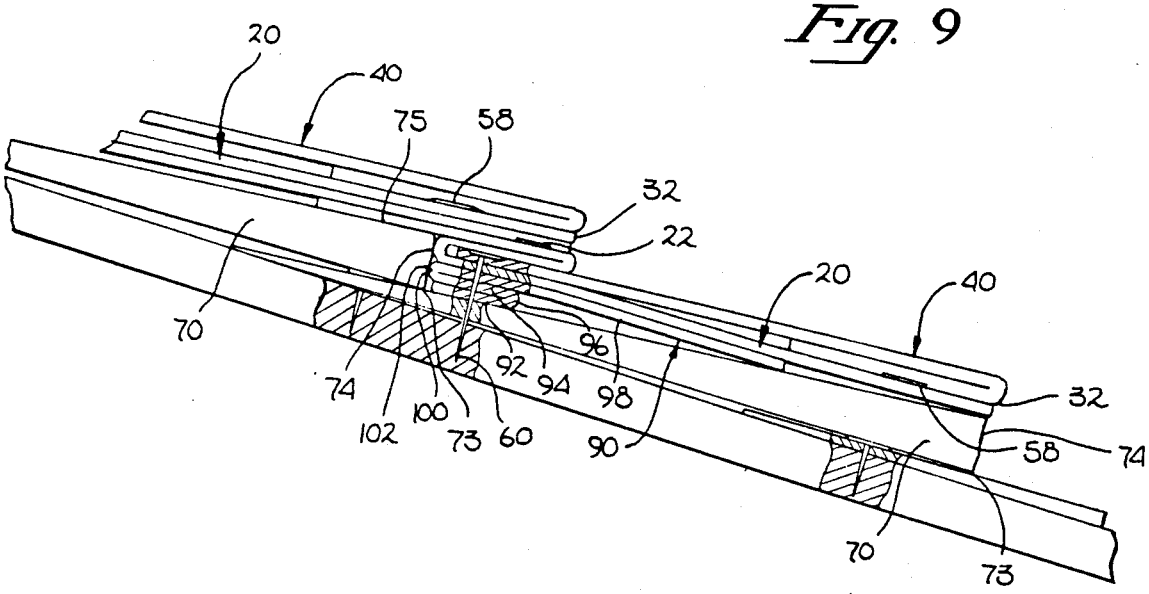
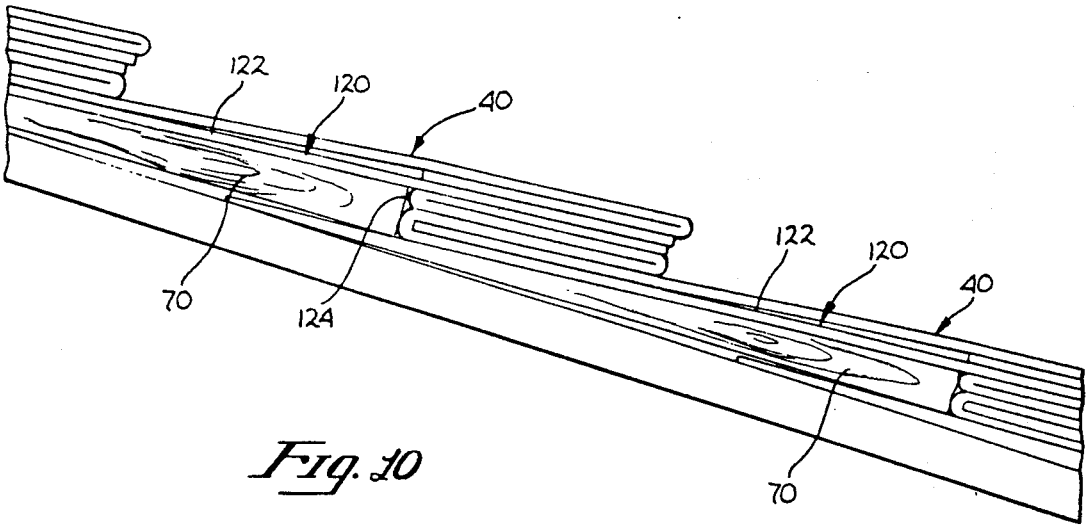
Fig. 10

MULTI-PIECE ASPHALT COMPOSITION ROOFING SYSTEM

This is a continuation of application Ser. No. 356,937, filed Mar. 10, 1982, now abandoned.

BACKGROUND OF THE INVENTION 1. Field of the Invention

The present invention relates to the field of roofing, and more particularly, non-metallic roofing such as asphalt composition.

2. Prior Art

Asphalt composition roofing materials are very well known in the prior art. These materials are relatively inexpensive and of light weight, thereby finding wide usage. Asphalt composition materials have been folded for various purposes, such as providing improved sealing characteristics and providing areas of increased thickness which create a three-dimensional appearance. Such folding is limited, with the resulting roof again having a highly repetitive design, lacking depth and texture as is generally characteristic of asphalt composition roofs. Examples of such folding may be found in U.S. Pat. Nos. 1,410,299; 1,435,623; 1,596,272; 1,848,965; 1,975,986; 2,253,753; and 3,913,294. In recent years, to enhance the appearance of asphalt composition roofs, various techniques have been used, including varying the thicknesses of the asphalt layer on the base material to provide texture, and use of different color granules on the lower portion of the shingle to provide a shading effect to create an illusion of a deeper three-dimensional roof. In general, the folding of the asphalt composition was difficult and cumbersome and often caused cracking about the folding line.

SUMMARY OF THE INVENTION

An asphalt composition roof covering system for roofing and reroofing is comprised of a base and a plurality of tabs cut from standard rolls of asphalt composition material. The base has first, second and third regions separated by a first and second fold so as to provide a "Z" shape. The plurality of folded tabs are inserted into the third region of the base to give a three-dimensional appearance. In addition, when the system is used for reroofing over existing shake roofs, a spacer may be provided along the inclined plane of a shake for raising the base to create a more natural looking appearance, or an alternate embodiment system, also disclosed, may be used.

BRIEF DESCRIPTION OF THE DRAWINGS

FIG. 1 is a top plan view of a sheet or portion of a roll of asphalt composition material from which a base of the roof covering system of the present invention is formed.

FIG. 2 is a botom plan view of the sheet of FIG. 1.

FIG. 3 is a detailed cross-sectional view of a folded base.

FIG. 4 is a cross-section of an alternate embodiment base in which there is a single fold.

FIG. 5 is a top plan view of a sheet of asphalt composition material from which the tabs of the roof covering system are formed.

FIG. 6 is a cross-sectional view of a folded tab.

FIG. 9 illustrates the application of the roof covering system of FIG. 7 to reroofing over a wood shake roof.

FIG. 10 illustrates the application of an alternate embodiment roof covering system for reroofing over a wood shake roof.

DETAILED DESCRIPTION OF THE INVENTION

Figure 7:
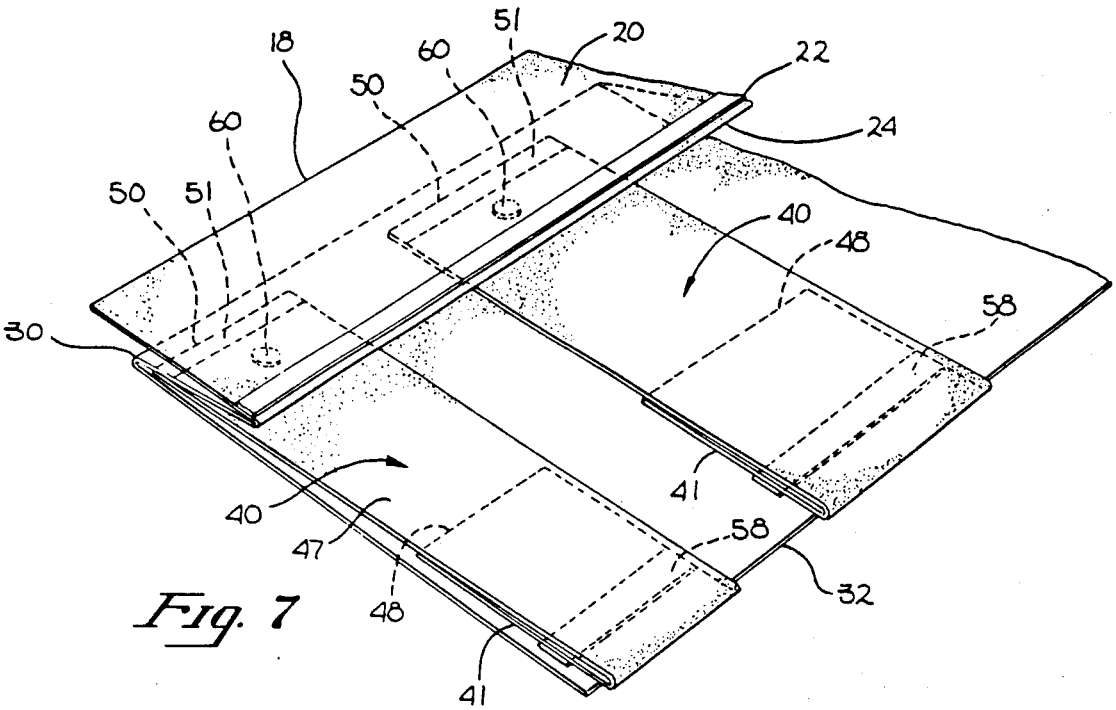
FIG. 7 is a perspective view of the roof covering system in accordance with the present invention.

Referring first to FIGS. 1 and 2, illustrating a typical base in accordance with the invention, a sheet 10 of asphalt composition roofing material such as a substrate of asphalt saturated felt has an upper granular surface 12 (shown in FIG. 1) and a lower smooth surface 11 (shown in FIG. 2). A center cut line 18 divides sheet 10 into first and second bases, each half being a mirror image of the other about line 18. The top surface 12 of base 20 scored (scraped or creased) to provide a fold line 24, i.e., a line of reduced resistance to bending, dividing surface 12 into first portion 13 and second portion 15. Adjacent to one side of line 24 is an adhesive strip 22. Adjacent to the other side of fold line 24 is an area 26 which is left free of granules, preferably by applying a strip 31 of plastic tape to the substrate prior to the application of the granules which will not stick to the plastic. Tape 31 which is affixed to surface 12 also serves as a hinge member along line 30, preferably defined by a crease in the bottom surface of the substrate (see FIG. 2), and provides additional structural support by holding the second portion 15 and third portion 17 together.

On the lower surface 11 directly below the line 24 is another strip 25 of plastic tape affixed thereto. The strip 25 which is affixed to surface 11 functions as a hinge member along fold line 24. Strip 25 serves to hold the first portion 13 and second portion 15 together in the event that the asphalt material cracks along the line 24 when subsequently folded. Also, strip 25 serves to prevent moisture from penetrating the exposed fold. The crease defining fold line 30 is directly underneath plastic tape 31, though not symmetrical therewith, and separates second portion 13 from third portion 17.

In the best mode of the invention the inner edge of the strip of adhesive 22 is approximately 3 to 3½ inches from the center cut line 18. Fold 24 is provided 4 7/16 inches from the center cut line 18. Granule free area 26 is approximately 2¾ inches wide, starting approximately 5 3/16 inches from center cut line 18. Score line 30 is located within area 26, about 7 3/16 inches from the center line 18 on surface 11. These measurements are based on using asphalt composition material that is one meter wide, and of course are exemplary of the preferred embodiment only. Preferably the bases are cut from rolls or continuous sheets of material so as to have a length in the range of 36 to 40 inches.

Base 20 comprises only one part of the roof covering system of the present invention. Additional parts, referred to herein as tabs 40, about to be described, are integrated with the base during installation and complete the roof covering system.

In FIG. 5, a second sheet 39 of asphalt composition material is partitioned to form tabs 40 above and below center cut line 48 having an upper granular surface 41 and a lower smooth surface (not shown). The ends of each tab 40 are left free of granules in regions 51 and 53. Each tab 40 is creased on the granular side 41 to provide a fold line 52 dividing the tab 40 into first portion 45 and second portion 47. On the lower side and aligned below folding line 52 is a strip of plastic tape 54. On surface 41 of each tab 40 is a strip 56 of adhesive material, normally covered by an overlying plastic tape 58 or some other suitable covering for protection from units sticking together during storage and shipment.

During installation, as shall be described in greater detail hereafter, base 20 is folded about the two fold lines 24 and 30 as shown in FIG. 3. This figure illustrates the approximate relative proportions of the base in the region of each of the two folds. In particular, the substrate of a typical asphalt composition roofing material is approximately one-half the thickness of the final material after application of the asphalt and granule layers. Thus in the region of tape 31 on each side of fold line 30, the asphalt composition material as a thickness of only approximately one-half that of other regions of the material having the granules thereon. Note further that the tape 31 is not positioned symmetrically with respect to the fold line 30, but rather is substantially unsymmetrical with respect thereto. Consequently, for the foregoing reasons, the effective thickness in the region of the fold around fold line 30 is approximately that of the normal asphalt composition material with granules, being comprised of two substrate layers, each having approximately one-half of that thickness. Moving away from the fold line 30, the thickness then increases to approximately three-halves of the thickness of the normal material with granules thereon as a result of the granules on the portion 17 of the base. Finally, going still closer to the fold line 24 and totally out of the region of the plastic tape 31, the thickness as a result of fold 30 further increases to the equivalent of twice the thickness of the basic material with granules thereon. Thus, the net result of the combination of the fold along line 30 and the absence of granules in an unsymmetrical pattern about the fold line is a very definite tapering of the thickness resulting from the fold, tapering from a minimum value in the region of the fold line 30 to a maximum value adjacent fold line 24. Obviously the same taper effect could be achieved by placing the plastic tape in a nonsymmetrical pattern in the opposite direction. In any event, the advantage of the taper is that portion 13 is elevated quite substantially in the region of the fold line 24, though the taper as hereinbefore described minimizes the step in portion 13 around fold 30 to the equivalent of approximately 1 thickness of the material, a step which is frequently encountered in asphalt composition roofing applications. Thus, the step beneath the portion 13 at fold line 30 is no more than normally encountered in the prior art.

When a roll of asphalt composition material 36 inches wide is used, the base 20' may be constructed having only a single fold made about fold line 30' as shown in FIG. 4. Strip 22' of adhesive would thereby be placed on the lower surface 11' near the center cut line 18' and would serve the same function as strip 22 of base 20.

As shown in FIG. 6, the individual tabs 40 are separated from the sheet shown in FIG. 5 along the center cut line 48 and the dashed lines between adjacent tabs, and a typical tab 40 has been folded about crease line 52, with the lower smooth side of first portion 45 lying flat against the lower smooth side of second portion 47. The folding of tab 40 may either be done at the factory or at the installation site, though folding at the installation is preferred, as it makes manufacture and packaging easier, and any splitting if folded cold is of little consequence because of the plastic stripes, i.e., plastic tape 54 acts as a hinge between the first and third portions and prevents the parts from separating along the fold line 52. Note from FIG. 5 that second portion 47 has a width slightly less than the width of first portion 45 and is offset inwardly from the sides of first portion 45 to produce an enhanced shadow effect which increases and emphasizes the depth of the roof covering system.

During installation, the bases 20 are laid edge to edge across the roof in a single course and, as shown in FIG. 7, the tabs 40 are inserted into bases 20 and nailed to provide one course of the roof covering system of the present invention. End 50 of each tab 40 is inserted into the fold created along line 30 of a corresponding base 20. The granule free region 26 of base 20 and strip 51 of each tab permits easy insertion of end 50 while minimizing the bulging which would otherwise occur at the fold due to granule buildup. Portion 47 of folded tab 40 is secured to the underlying granular surface of base 20 by the asphalt strip 58 which adheres to the base when warmed by the sun. The end 50 of first portion 45 is secured to the granule free area 26 of third portion 17 of base 20 and to the roof by a nail 60 passing through the end 50 and third portion 17 into the underlying sheathing of the roof. In this manner, the nail will not be visible, even before the next course is applied. However, the nail may also be installed so that it goes through the entire folded base and still provide double coverage in the finished roof as a result of the next course. Obviously, a number of tabs 40 of varying width may be positioned and secured to base 20 to create a more natural looking appearance, with a tab always being positioned over the region of abutment of two adjacent bases to provide a water barrier at that location.

Figure 8:
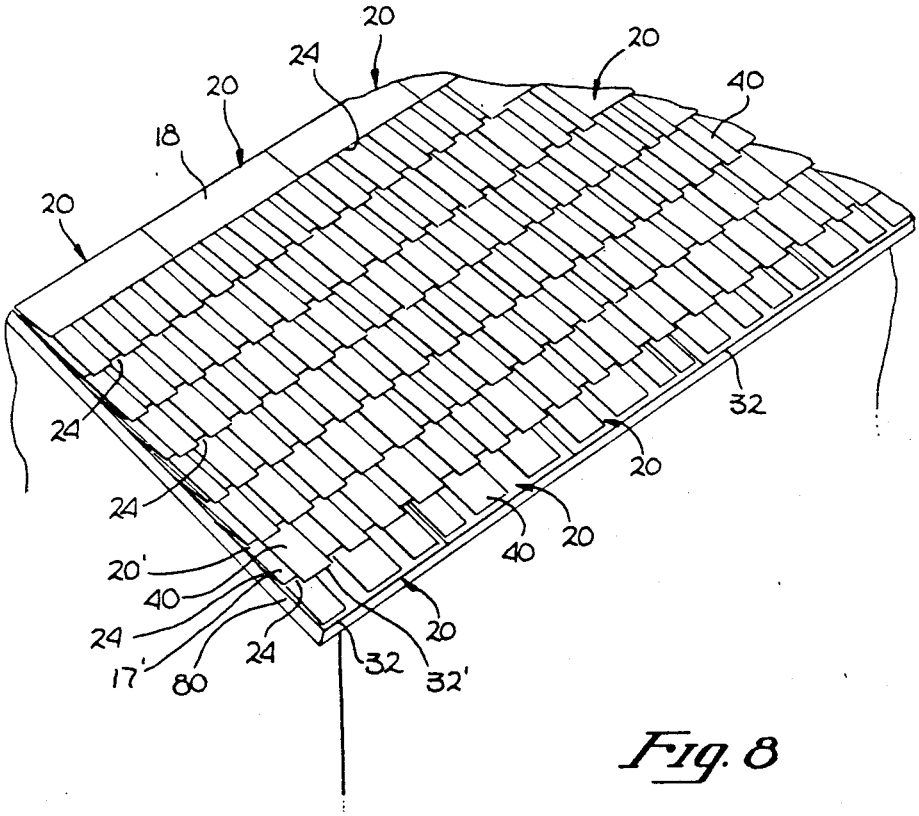
FIG. 8 is a sectional view of a roof covered by the roof covering system of the invention.

As shown in FIG. 8, once the first course 80 of the roof covering system has been placed upon the roof, a second course 82 will be laid, with the lower edge of the third portion 17' of a second base 20' aligned with fold line 24 of the first course of bases. Thus, adhesive strips 22 on the first course will soften when warmed by the sun and adhere to the underside of the third portion 17' of the second course. This will prevent the bottom edge 32 of third portion 17' from lifting in heavy winds. A small section of a roof having several rows installed is illustrated in FIG. 8.

The description of the roof covering system thus far clearly illustrates the suitability of the roof covering system for installation on a flat roofing surface such as a layer of plywood. However, the same roof covering system is easily adaptable for installation over an existing thick shake roof by utilizing a spacer 90 as illustrated in FIG. 9 and discussed below.

An edge 74 of a pre-existing shake 70 presents a discontinuity in the surface over which the roof covering system is to be installed. The height of the discontinuity is substantially greater than that which can be readily accommodated solely by the base 20 and tabs 40 combined. However, by placing a spacer 90 at the foundation 73 of the edge 74, the effective height of the discontinuity can be reduced as desired. The spacer may be made of a piece of folded apshalt composition material, a long strip of thin wood molding or any other material having a thickness sufficient to raise base 20 to approach or even be flush with bottom edge 74. In the preferred embodiment, spacer 90 is an asphalt composition material folded about a first fold line 96 to form layers 92 and 94, and layer 94 folded about a second fold line 100 to form a third layer 98. The result is a thickened end 102 comprising layers 92, 94 and 98. The thickened end 102 is positioned to abut the edge 74 of a course of shake 70. Therefore, a base 20 is positioned atop the spacer 90 so that the first portion 13 of the base 20 will be approximately flush with the top 75 of edge 74. While normally the spacer will be temporarily attached to the roof, nails 60, driven through end 50 of tab 40, third portion 17 of base 20 and spacer 90 finally secures the roof covering system to the wood shake and the sheathing therebeneath. The process is then repeated until the roof is covered. In wood shingle reroofing, a spacer generally would not be required.

Now referring to FIG. 10, the installation of the roof covering system of the present invention using an alternate embodiment base to provide coverage over an existing wood shake roof without requiring a spacer as in FIG. 9 may be seen. in this embodiment, a typical base generally indicated by the numeral 120 has a lower panel or region 122, the function of which is the same as in the earlier embodiments. However, rather than merely having the Z shape fold as in the primary embodiment, each base 120 of FIG. 10 has an additional fold 124 so that the upper edge region of each base 120 overlies the multiple thickness region by the Z shape fold thereunder. This additional fold serves two purposes. First, the additional fold provides one additional thickness of asphalt composition material in the folded region to provide an additional thickness in the folded stack to better match the thickness of the thick wood shake 70. In addition, this final fold prevents the top edge region of each base from overlying the lower edge of the next shake thereabove (such overlying may be seen in FIG. 9). The net result is that the folded stack will closely approximate the thickness of typical thick wood shake so that no separate spacer is required with this embodiment. Aside from the bases themselves of course, the roof may be finished by the insertion in the usual manner of tabs 40.

There has been disclosed and described herein a roof covering system which utilizes lightweight and relatively inexpensive asphalt composition material to achieve a roofing product giving the appearance of substantial depth and texture to the roof. No part of the roof covering system is ever folded to more than three thicknesses, thus providing easy manipulation and cutting of the pieces. In areas where cutting of the multiple thicknesses is necessary, such as in the valleys, the system can easily be unfolded before cutting so that cutting of only one thickness is required.

Figure 11:
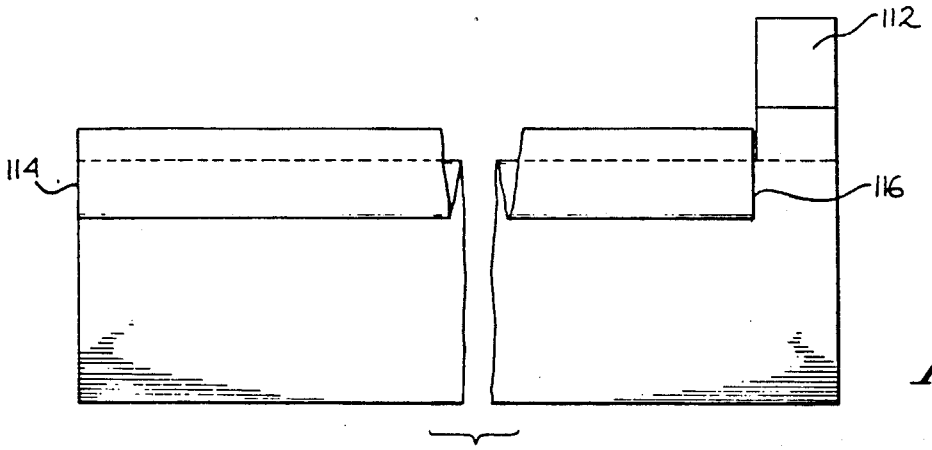
FIGS. 11 and 12 illustrate the folding and installation of bases alone to provide a low cost roof covering system.

In certain instances it may be desired to partially or totally eliminate the tabs to provide a low cost, high quality roof covering system. By way of example, one might desire to use the tabs with the roofing system hereinbefore described on the front facing portion of a house roof to provide maximum decorative effect while desiring a compatible though minimum cost covering on the rearward facing portion of the roof because of its lack of visibility, or because the appearance of the rearward facing portion of the roof will be less than ideal anyway because of roof mounted air conditioners, vents, solar collectors, etc. In still other instances it may be desired to provide a decorative roof on a home and thus use the tabs as hereinbefore described, but to provide a somewhat less decorative yet visually compatible and highly utilitarian covering on nearby detached buildings such as implement sheds, barns, garages and the like. In such instances, the bases of the present invention may be used without the tabs to provide the desired covering, as illustrated in FIGS. 10 and 11 and as hereafter described.

Figure 12:
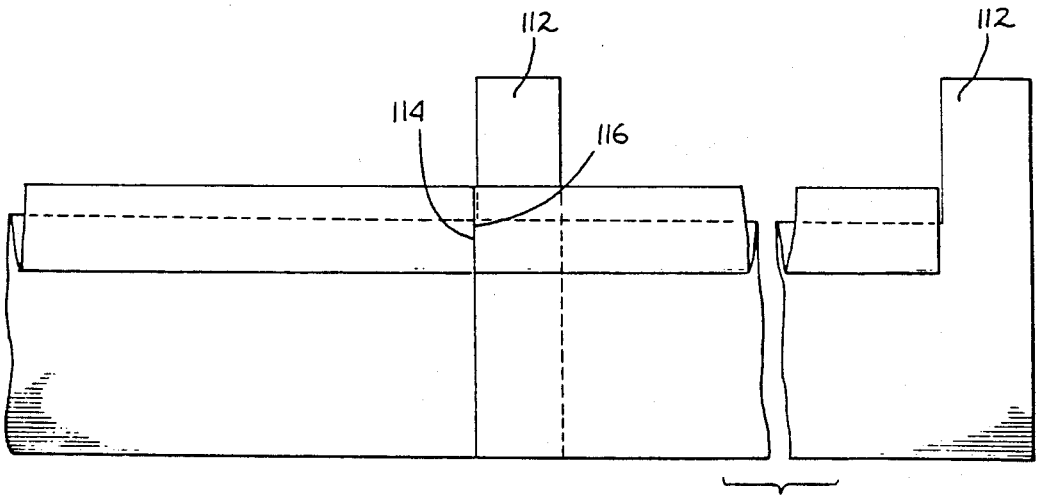

As shown in FIGS. 1 and 2, but not before described, each of the bases have a slit 110 extending from the center cut line 18 to the fold line 30 parallel to and approximately 4 inches in from the edge of the base. In the installation herein before described using the tabs in conjunction with the bases, the bases are folded as described without regard to the presence of the slits 110 therein. However, when using the bases without the tabs for a high quality yet low cost roof covering, the main portion of the base is folded as was illustrated with respect to FIG. 3, but the approximately 4 inch tab 112 is left unfolded as shown in FIG. 11. As illustrated in FIG. 12, the first base is then laid starting at the lower left corner of the roof, preferably by nailing through the base under the top flap of the fold so that that flap together with the lower portion of the base on the next course will provide double coverage. Then the next base for the same course is placed adjacent but overlapping the tab 112 of the first installed base so that the left edge 114 of the folded region of the second base substantially abuts the right edge 116 of the folded region of the first base. In this manner, a significant overlap of adjacent bases in a course is achieved to provide the desired water barrier in that region. The laying of the roof of course proceeds left to right and upward on a course to course basis until the roof is complete, the next course being laid so that the lower edge of each base extends slightly over the folded region of the course therebelow to provide a pronounced and attractive shadow line for each course. Each course, of course, is preferably staggered with respect to the course immediately therebelow (as is preferably done with the previously described embodiment) to provide a continuous coverage over the region of abutment of the sides of the folded region 114 and 116 of adjacent bases. The net result is a highly functional, low cost roof of perhaps reduced aesthetic character, though still quite attractive as a result of the pronounced horizontal shadow lines in comparison to the very flat appearance of typical prior art low cost asphalt composition roofing installations.

In the preferred embodiments described herein, the bases are cut in lengths of approximately 40 inches, but not folded at the mill so that they may be easily stacked flat for shipment. It should be recognized however, that the bases may be formed but not cut to length at the factory, but instead shipped in a roll so that the bases may be rolled out across a roof for further ease in installation. Care must be taken however, to avoid what is referred to "fish mouths", particularly when installed in cool weather, as particularly the more tightly rolled portions of a roll will not want to readiy lie flat on the roof when first unrolled. Generally speaking however, this problem may be overcome by unrolling the rolls on the roof while cutting the bases in substantial lengths, such as by way of example, ten foot lengths or even full roof widths, and allowing the unrolled material to sit for a day or so prior to installation. In such a case, of course, one would normally not use the tabs as illustrated in FIGS. 11 and 12 but rather use the embodiment of FIG. 1 without the tab slits.

While the invention has been described with particular reference to the embodiments illustrated in FIGS. 1 through 11, the figures and discussion are intended as illustrative of the invention and should not be interpreted as limitations upon the invention. It should be understood that many changes in configuration and substitutions of material may be made by one of ordinary skill in the art without departing from the spirit and scope of the invention as set forth in the appended claims.

I claim:

1. An asphalt roof covering system comprising:

a base of asphalt composition material characterized by a top granular surface and a bottom surface having a predetermined width and having a first base fold line extending across the base between upper and lower edges of said base dividing said base into first and second base portions between said lower and upper edge of said base, respectively, said first base portion having a predetermined length, said second base portion having a top surface;

a second sheet of asphalt composition material characterized by a top granular surface and bottom surface comprising at least one tab having a predetermined width and a first tab fold line extending across the width of said tab between upper and lower edges of said tab dividing said second sheet into first and second tab portions between said upper and lower edges of said tab, respectively, said first and second tab portions having bottom surfaces and said first tab portion having a top portion, said tab having a width which is substantially less than said width of said base, said first tab portion having a length which is approximately equal to said length of said first base portion, said first base portion being positioned with its bottom surface on a roof with said first base fold line disposed horizontally and with said second base portion above said first base portion;

the first portion of each said tab being placed with the upper edge thereof proximate said first base fold line such that said second tab portion is folded beneath said first tab portion along said tab fold line such that said bottom surface of said second tab portion lies against said bottom surface of said first tab potion, the second base portion being folded along said first base fold line such that part of said top surface of said second base portion of said tab lies against a part of said top surface of said first tab portion whereby areas of said tab are exposed and said exposed areas and said first base portion provide a three dimensional highly textured appearance.

2. The system of claim 1, wherein said base further comprises a second base fold line between said first base fold line and the upper edge of said base, said second base portion being folded about said second base fold line to provide a third portion such that the bottom surface of said third base portion overlies the bottom surface of said base portion.

3. The system of claim 1, wherein said granular surface of said second tab portion has an adhesive strip thereon for affixing said second tab portion to said first base portion.

4. The system of claim 1, further comprising securing means for securing said first tab portion to said first base portion and to the roof.

5. The system of claim 1, wherein said second sheet of asphalt composition material comprises a plurality of tabs separated by lines of reduced resistance to bending.

6. An asphalt roof covering system comprising:

a first sheet of asphalt composition roofing material characterized by a first granular surface, and a first lower surface, comprising a base having a first base portion, a second base portion having a first granular surface and a third base portion having a first surface, said base being folded about a first base fold line between said second base portion and said third base portion so that said first granular surface of said second base portion overlies said first surface of said third base portion; and said base being folded in an opposite direction about a second base fold line between said first base portion and said second base portion such that said first lower surface comprised of said first base portion of said base, overlies said first lower surface comprised of said second base portion of said base, a second sheet of asphalt composition roofing material characterized by a first granular surface and a second lower surface, comprising at least one tab having a width substantially less than the width of said base and having a first tab portion having a third lower surface and an unfolded end, and a second tab portion, having a fourth lower surface said tab being folded about a first tab fold line between said first tab portion and said second tab portion, said fourth lower surface of said second tab portion lying flat against said third lower surface of said first tab portion, said unfolded end of said first tab portion being placed adjacent to said second base fold line and affixed thereto with said second tab portion of said tab lying flat against said granular surface of said third base portion.

7. The system of claim 6, wherein each of said bases has a plurality of tabs affixed thereto.

8. The system of claim 6, wherein said third base portion is proportionately longer than the first base portion.

9. The system of claim 6, wherein said first tab portion is slightly wider than said second tab portion.

10. The system of claim 6, wherein the first and second base folds are secured by a strip of tape.

11. The system of claim 6, wherein a first strip of tape is affixed to the smooth surface of said base under said second base fold line and a second strip of tape is affixed to the granular surface of said base under said second base fold line.

12. The system of claim 6, wherein a strip of tape is affixed to the lower surface of said tab under the tab fold line.

13. The systems of claim 6, wherein the granular surface of said base has been removed in the region of the first fold line.

14. The system of claim 6, wherein the granular surface of the unfolded end of the first tab portion has been removed.

15. The system of claim 6, wherein said granular surface of said base has an adhesive strip affixed thereon adjacent to said first fold.

16. The system of claim 6, wherein said granular surface of the second tab portion has an adhesive strip thereon for affixing said second tab portion to said third base portion.

17. The system of claim 6, for use on a roof having pre-existing shakes of various heights further comprising a spacing means affixed to said base for raising said base so that said first base portion is flush with the height of an abutting course of shake.

18. The system of claim 17, wherein the spacing means comprises a third sheet of asphalt composition material characterized by a top granular surface, said third sheet having a first portion, a second portion and a third portion, said first portion being folded about a first fold line between said first and second portions and said third portion being folded about a second fold line between said second and said third portion, whereby said third portion rests against the underlying shingle and said first portion is affixed to said base.

19. An asphalt roof covering system, comprising:

a first sheet of asphalt composition roofing material characterized by an upper granular surface and a lower surface, comprising a base having a first base portion and a second base portion, said second base portion being folded about a first fold line between said first and second base portions whereby said second base portion lies substantially against said first base portion;

a second sheet of asphalt composition roofing material characterized by an upper granular surface and a lower surface, comprising one or more tabs, each tab being substantially narrower than said base, and each tab having a first tab portion having a first end, and a second tab portion, said first tab portion being folded about a tab fold line between said first tab portion and said second tab portion, said first tab portion lying against said lower surface comprised of said second tab portion of said one or more tabs, said first end of said first tab portion each being positioned adjacent to said first fold line on said first base portion under said second base portion and affixed thereto with said second tab portion of said tab lying against said upper granular surface of said first base portion, whereby areas of said tabs are exposed and said exposed areas and said first base portion provide a three dimensional highly textured appearance.

20. The system of claim 19, wherein said second base portion is folded about a second fold line to provide a third base portion such that the lower surface of said third base portion overlies the lower surface of said second base portion.

21. The system of claim 19, for use on a roof having pre-existing shingles of a predetermined height further comprising a spacing merans affixed to said base for raising said first base portion adjacent said first fold line flush with the height of an abutting shingle.

22. An asphalt roof covering system comprising a base of asphalt composition material characterized by a granular coating on said base having first, second and third portions folded in a "Z" shape, wherein the third portion of the "Z" is substantially longer than the first portion;

one or more tabs each having a width substantially less than a width of said base and each comprising a first portion having first and second ends, and a smaller second portion folded under said second end of said first portion, the first end of the first portion of each tab fitting between the third and second portions of said base and being affixed thereto, and said second portion of the tab being affixed to the third portion of said base.

23. The system of claim 22, wherein the granular surface has been removed in the region of the fold in "Z" shaped base between said second and third base portions.

24. An asphalt roof covering system comprising:

a plurality of bases of asphalt composition material, each base characterized by a top granular surface and a lower surface having a first base fold line dividing the base into first and second portions, and having a slit proximate one end of said base extending perpendicularly through said second portion to said first base fold line to provide a tab, wherein the width of said tab is substantially narrower than the width of said base, each of said bases being folded about said first base fold line such that the top granular surface of the second portion overlies the top granular surface of said first portion, said tab being left unfolded, said bases to be installed upon a roof in courses, the folded region adjacent one side of a base overlying a portion of the adjacent base which is adjacent the tab of said adjacent base, and the first base portion of the bases in one course overlying the folds in a next lower course of bases.

25. The system of claim 24, wherein each of said bases further comprises a second base fold line, said slit extending to said second base fold line, whereby said second portion may be folded about said second base fold line to provide a third portion such that the lower smooth surface of said third portion overlies the second surface of said second portion, said tab remaining unfolded.

26. An asphalt roof covering system comprising:

a first sheet of asphalt composition roofing material characterized by a first granular surface, and a lower surface, comprising a base having a first portion, a second portion, and a third portion, and having a slit proximate one end of said sheet, extending through said second and third portions to create a tab, wherein a width of said tab is substantially narrower than a width of said base, said third portion being folded about a first fold line between said second portion and said third portion so that the first granular surface of said second portion overlies the first granular surface of said third portion; and said first portion being folded in an opposite direction about a second fold line between said first portion and said second portion such that the lower surface of said first portion overlies the lower surface of said second portion, said tab remaining unfolded.

27. The systems of claim 26, wherein the first and second fold lines are secured by a strip of tape.

28. The system of claim 26, wherein a first strip of tape is affixed to the smooth surface of said base under said second fold line and a second strip of tape is affixed to the granular surface of said base at said first fold line.

29. The system of claim 26, wherein the granular surface of said base has been removed in the region of the first fold line.

* * * * *